US006099024A

United States Patent [19]

Liao

[11] Patent Number: 6,099,024

[45] Date of Patent: Aug. 8, 2000

[54] GOLF CART COLLAPSIBLE DEVICE

[75] Inventor: Gordon Liao, Yung Kang, Taiwan

[73] Assignee: Unique Product & Design Co., Ltd., Tainan Hsien, Taiwan

[21] Appl. No.: 09/334,714

[22] Filed: Jun. 16, 1999

[51] Int. Cl.[7] ..... B62B 1/04; B62B 1/12; B62B 3/02; B62B 3/10

[52] U.S. Cl. ..... 280/655; 280/47.17; 280/47.26; 280/47.315; 280/DIG. 6

[58] Field of Search ..... 280/639, 38, 641, 280/39, 40, 645, 651, 652, 655, 47.17, 47.18, 47.131, 47.24, 47.315, 47.26, 47.27, DIG. 6; 403/59, 100, 102; 190/115

[56] References Cited

U.S. PATENT DOCUMENTS

| | | | |
|---|---|---|---|
| 2,701,725 | 2/1955 | Meiklejohn | 280/DIG. 6 |
| 3,479,052 | 11/1969 | Spielman | 280/645 |
| 4,340,236 | 7/1982 | Seibold et al. | 280/38 |
| 4,513,989 | 4/1985 | Czajkowski | 280/645 |
| 4,936,598 | 6/1990 | Lee | 280/645 |
| 5,201,540 | 4/1993 | Wu | 280/646 |
| 5,306,027 | 4/1994 | Cheng | 280/30 |
| 5,348,325 | 9/1994 | Abrams | 280/40 |
| 5,421,604 | 6/1995 | Wu | 280/655 |
| 5,439,239 | 8/1995 | Su | 280/40 |
| 5,451,072 | 9/1995 | Weng | 280/646 |
| 5,582,421 | 12/1996 | Liu | 280/646 |
| 5,630,601 | 5/1997 | Braucke et al. | 280/40 |
| 5,639,109 | 6/1997 | Liang | 280/655 |
| 5,692,266 | 12/1997 | Tsai | 16/115 |
| 5,727,898 | 3/1998 | Lu | 403/325 |
| 5,746,440 | 5/1998 | Chen | 280/652 |
| 5,803,471 | 9/1998 | DeMars et al. | 280/40 |
| 5,864,921 | 2/1999 | Chou | 16/115 |
| 5,875,520 | 3/1999 | Chang | 16/115 |

*Primary Examiner*—Christopher P. Ellis
*Assistant Examiner*—Bridget Avery
*Attorney, Agent, or Firm*—Pro-Techtor International Services

[57] ABSTRACT

A golf cart collapsible device includes a lock base provided on two parallel handle bars and on top of two parallel frame tubes. The lock base has a bar hole each at two ends for containing a spring and a first sleeve fixing around each handle bar, enabling the lock base move up and down for a limited distance along the handle bars. Each frame tube has a pivot base fixed on an upper end, and the pivot base has a center hole for a second sleeve to fit in. Each second sleeve has a guide surface communicating with the center hole. Each handle bar has a first end pivotally connected with the pivot base so that the two handle bars may be swung up for 180 from a collapsed position to an expanded position, with the lock base automatically pushed down by the springs to force its engage members fit in the second sleeves to lock the handle bars in the expanded position.

6 Claims, 10 Drawing Sheets

GOLF CART COLLAPSIBLE DEVICE

BACKGROUND OF THE INVENTION

This invention relates to a golf cart collapsible device, particularly to one automatically engaging and quickly expanded.

Conventional golf cart collapsible devices have different structures effecting its expansion by slide blocks, hooks, bolts, etc., but none of them are provided with automatic engaging function to attain swift expansion.

SUMMARY OF THE INVENTION

The main objective of the invention is to offer a golf cart collapsible device possible to be expanded swiftly and locked in the expanded position automatically.

The feature of the invention is two parallel handle bars pivotally connected to two parallel frame tubes so that the two handle bars may be swung up for 180 degrees from a collapsed position to an expanded position, and a lock base fixed on the handle bars may lock the handle bars against the two frame tubes in the expanded position by moving up and down for a limited distance along the two handle bars.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
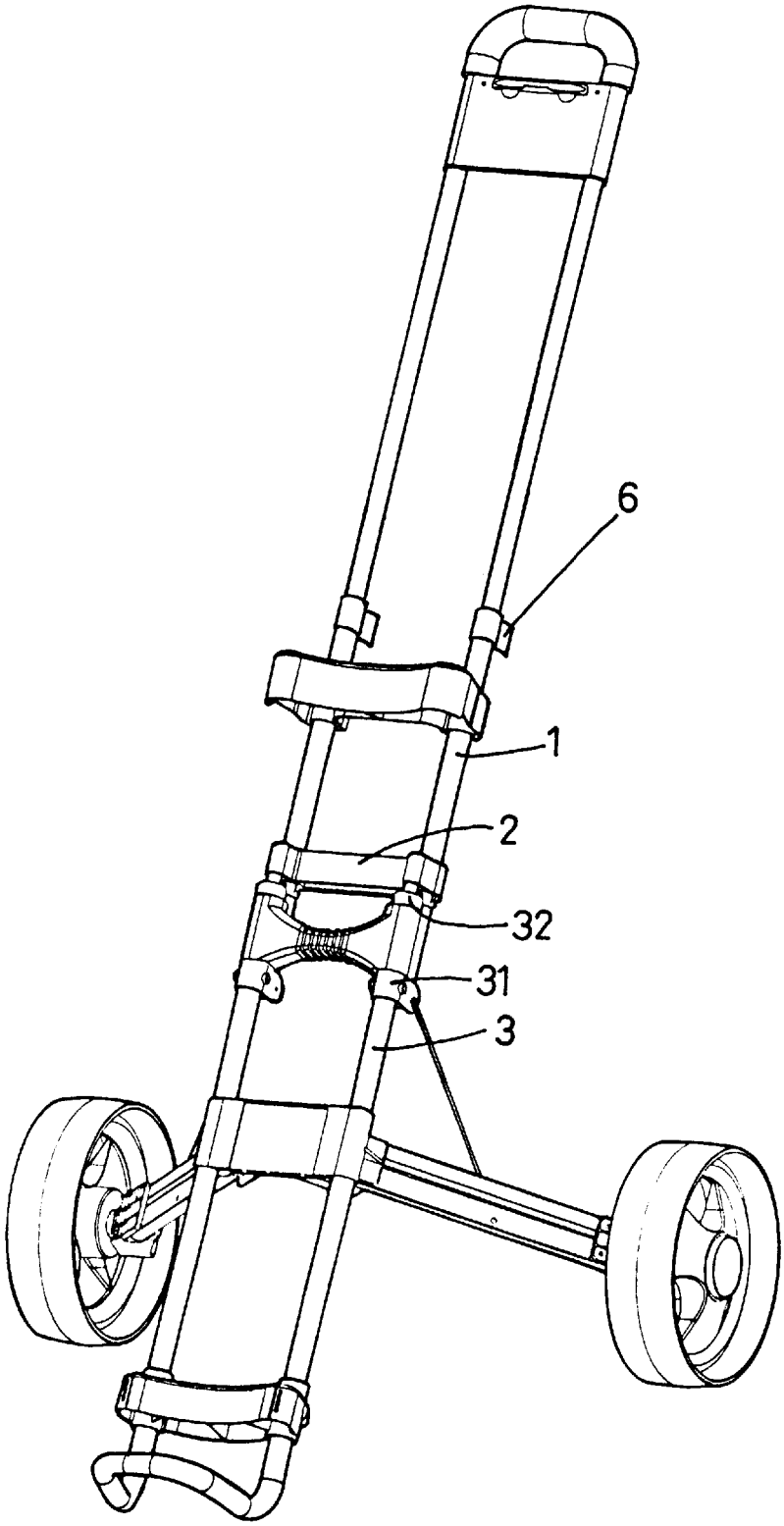
FIG. 1 is a perspective view of a golf cart provided with a collapsible device in the present invention.
Figure 2:
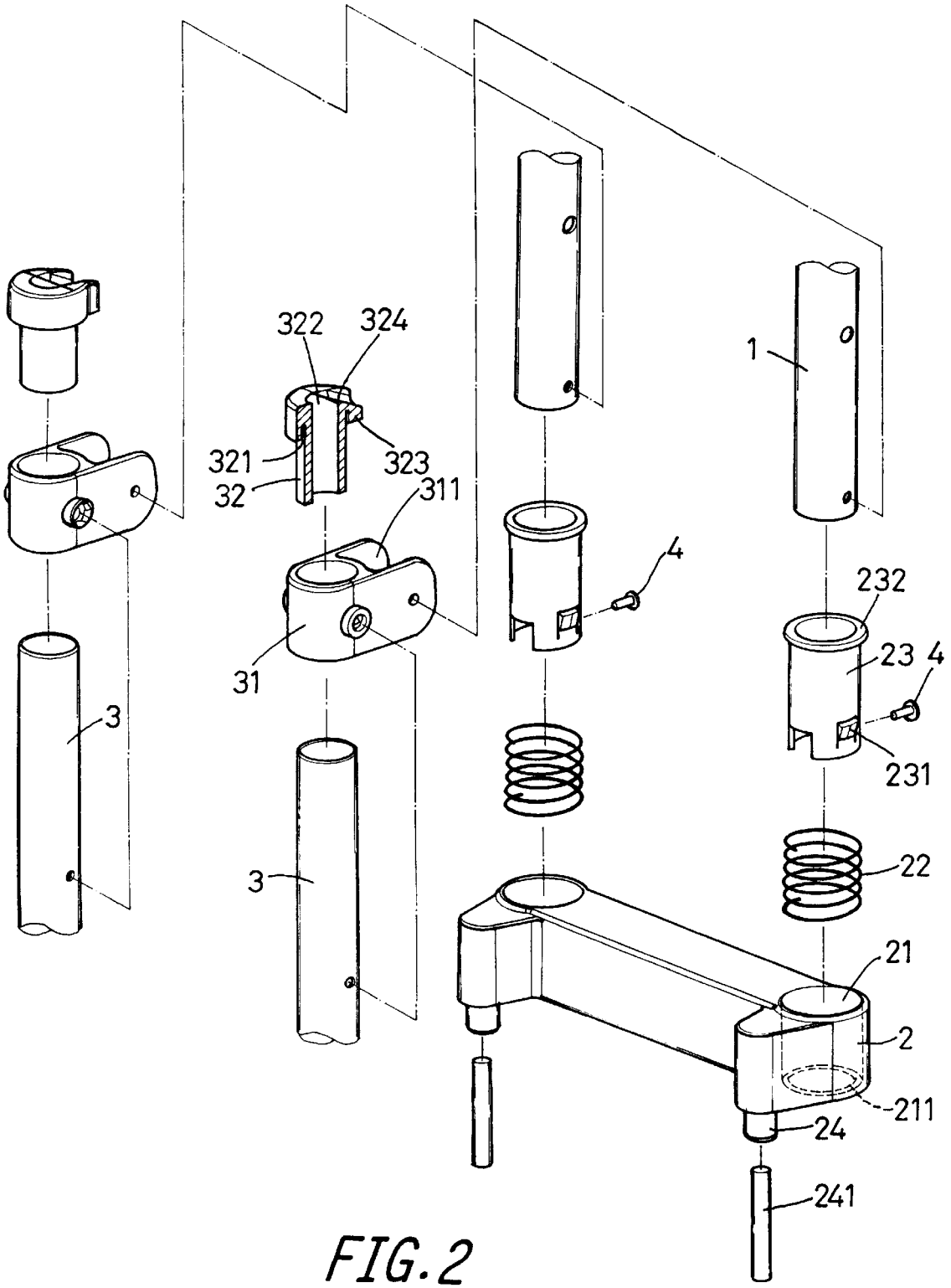
FIG. 2 is an exploded perspective view of the golf cart collapsible device in the present invention.

A preferred embodiment of a golf cart collapsible device in the present invention, as shown in FIGS. 1, 2, 3 and 4, includes two parallel handle bars 1, two parallel frame tubes 3, and a lock base 2 provided on the two handle bars 1 and on top of the frame 3, as main components.

The lock base 2 has a bar hole 21 respectively in two (right and left) ends, a lower annular inner projection 211 formed in a lower end of each bar hole 21, a coil spring 22 contained in each bar hole 21, a first hollow sleeve 23 in each coil spring 22 in each bar hole 21 and passed through by and fixed with each handle bar 1 with a rivet 4. The first hollow sleeve 23 further has a tenon 231 projecting out from an outer surface and to be stopped by the lower inner annular projection 211. Each first sleeve 23 has an upper flange 232 for limiting the coil spring 22 between the flange and the lower inner annular projection 211 so that the lock base 2 may move up and down in a limited distance by means of resilience of the soil springs. The lock base 2 further has an engage member 24 extending down from a rear side of each bar hole 211, and a pin 241 provided in a center hole of the engage member 24 to reinforce the engage member 24.

The two parallel frame tubes 3 respectively have a pivot base 31 fixed on the top, and the pivot base 31 has a U-shaped connect opening 311 for a bolt 5 pivotally connecting each handle bar 1 with the pivot base 31 and thus with each frame tube 3. Consequently the two handle rods 1 may be swung up and down for 180 degrees from collapsed position to an expanded position with the bolts 5 as pivots. Further, a second sleeve 32 is provided to fit in a top of each frame tube 3, having an annular groove 321 in an upper portion to engage with the top annular wall of the frame tube 3, a center hole 322, a guide projection 323 formed on a side of the upper portion, and a tapered surface 324 formed on an upper surface of the guide projection 323 communicating with the center hole 322.

Figure 3:
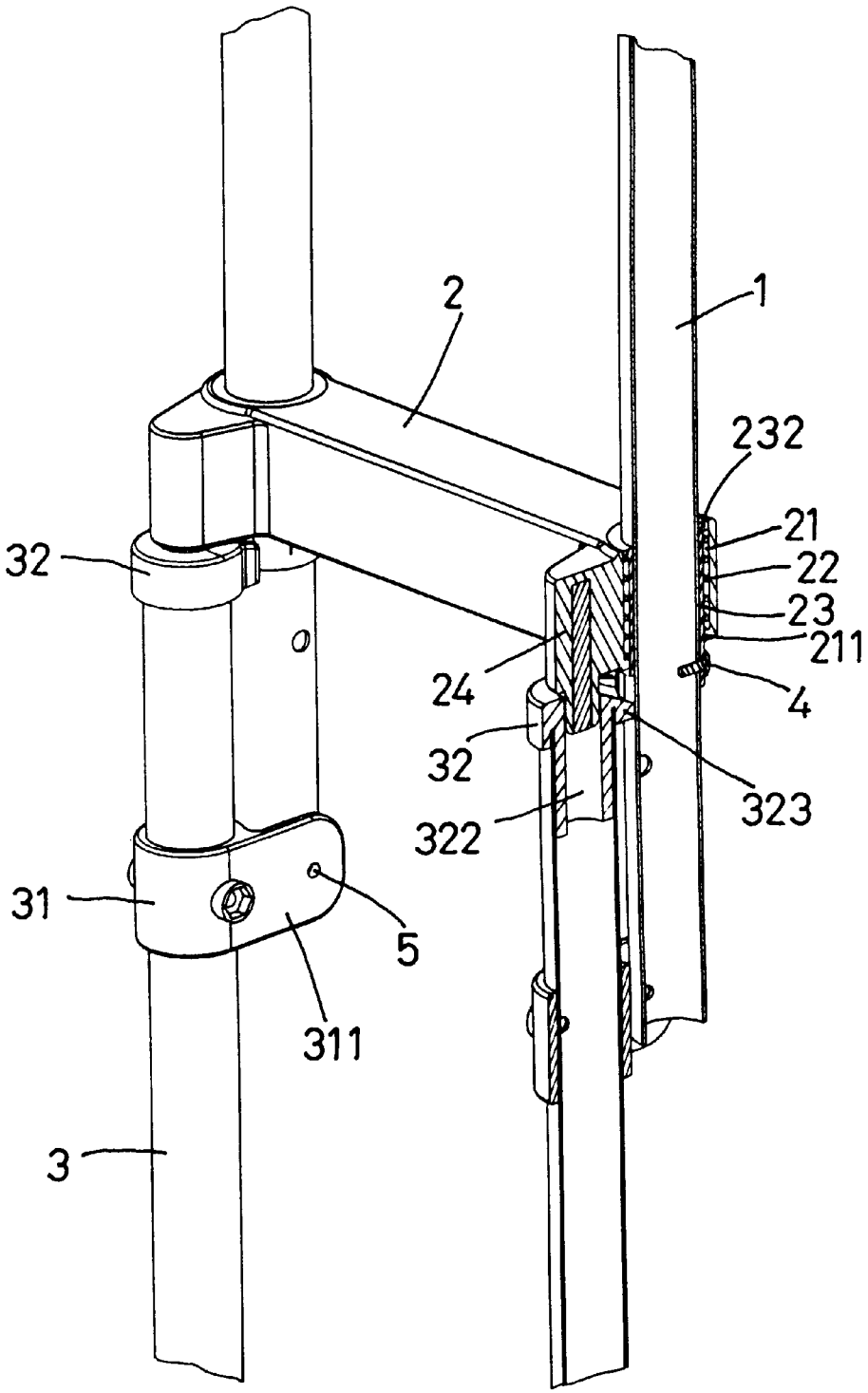
FIG. 3 is a perspective view of the golf cart collapsible device in an expanded position in the present invention.
Figure 4:
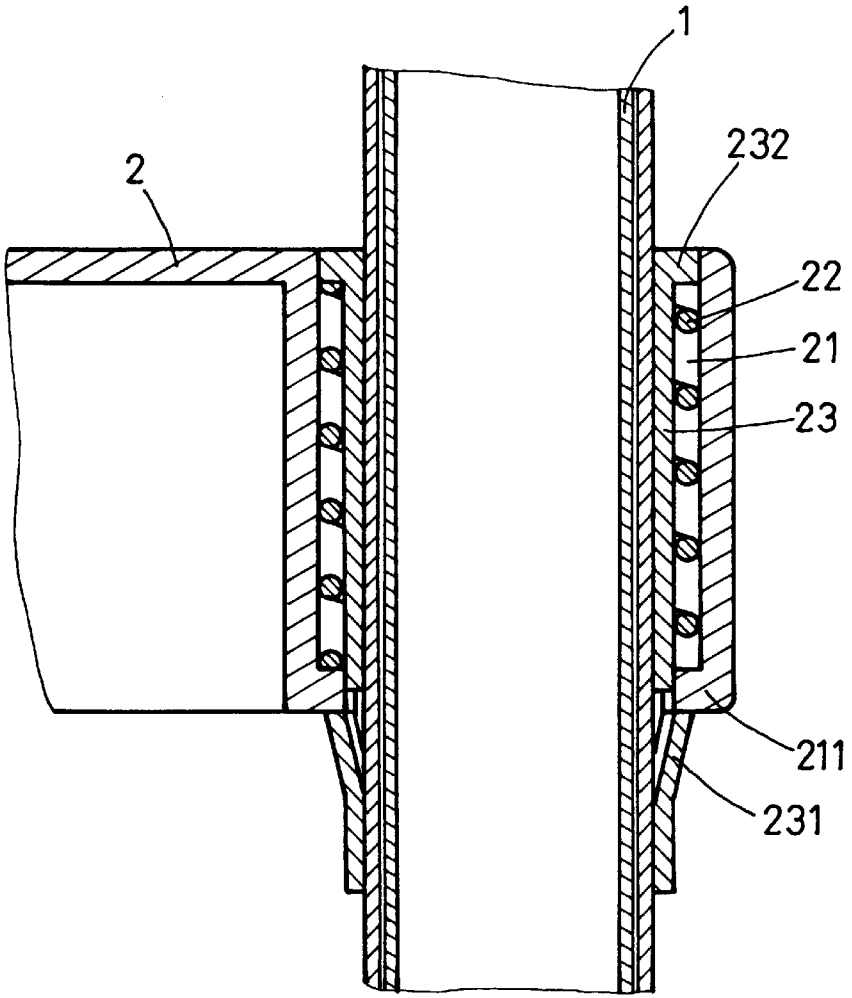
FIG. 4 is a partial cross-sectional view of a lock base in the present invention.
Figure 5:
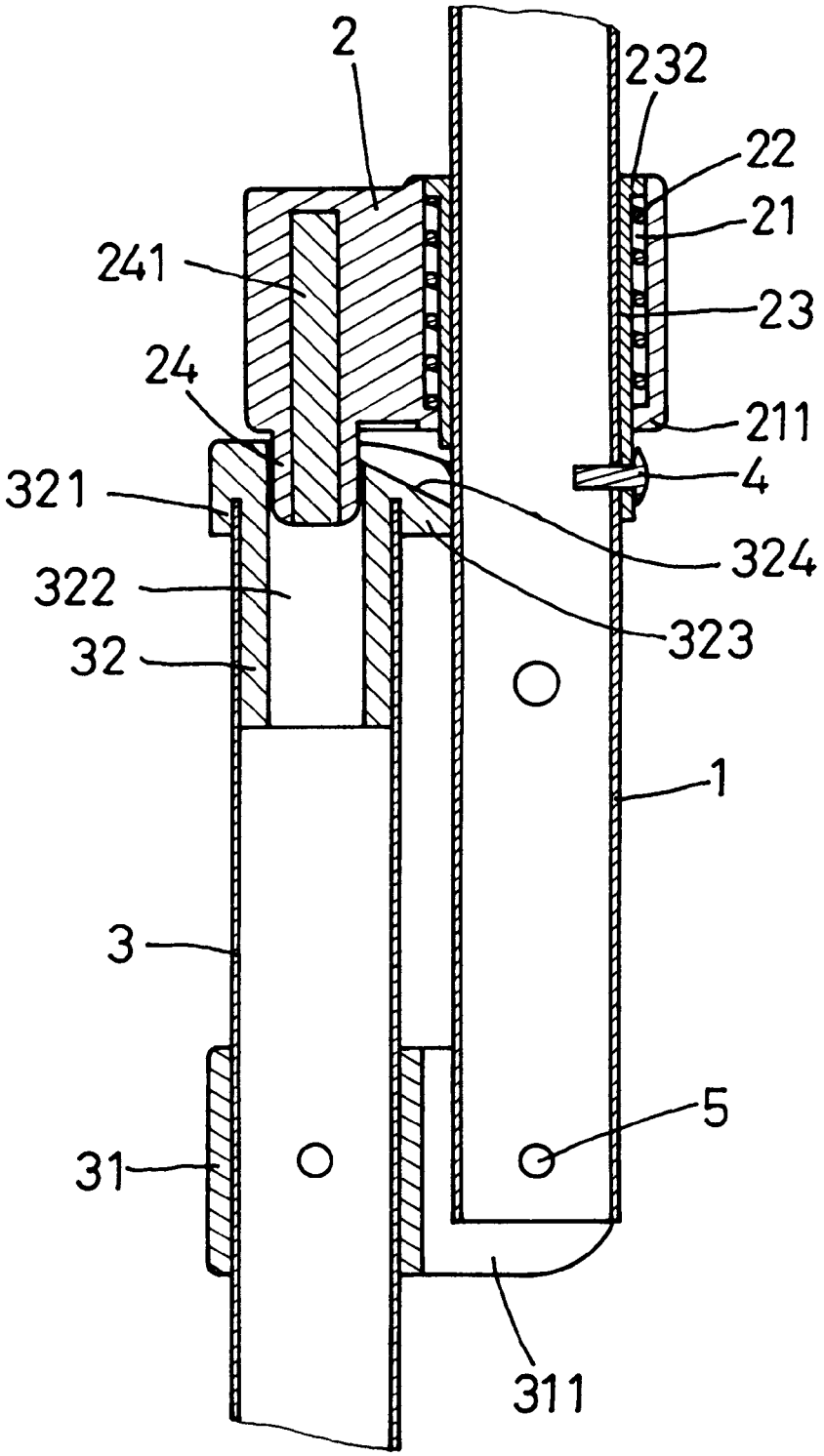
FIG. 5 is a cross-sectional view of the golf cart collapsible device in the expanded position in the present invention.
Figure 6:
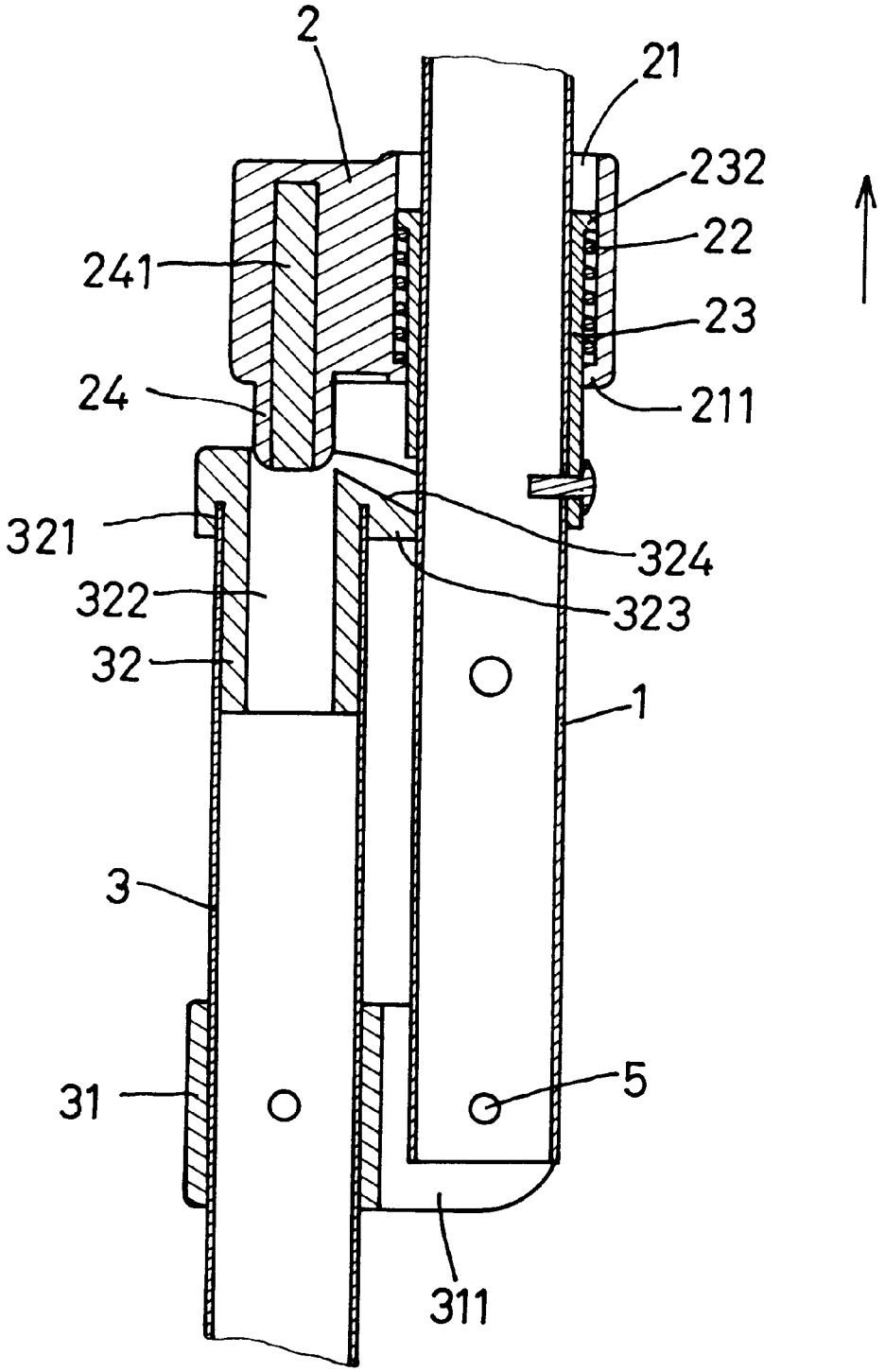
FIG. 6 is a cross-sectional view of a first stage of collapsing process of the golf cart collapsible device in the present invention.
Figure 7:
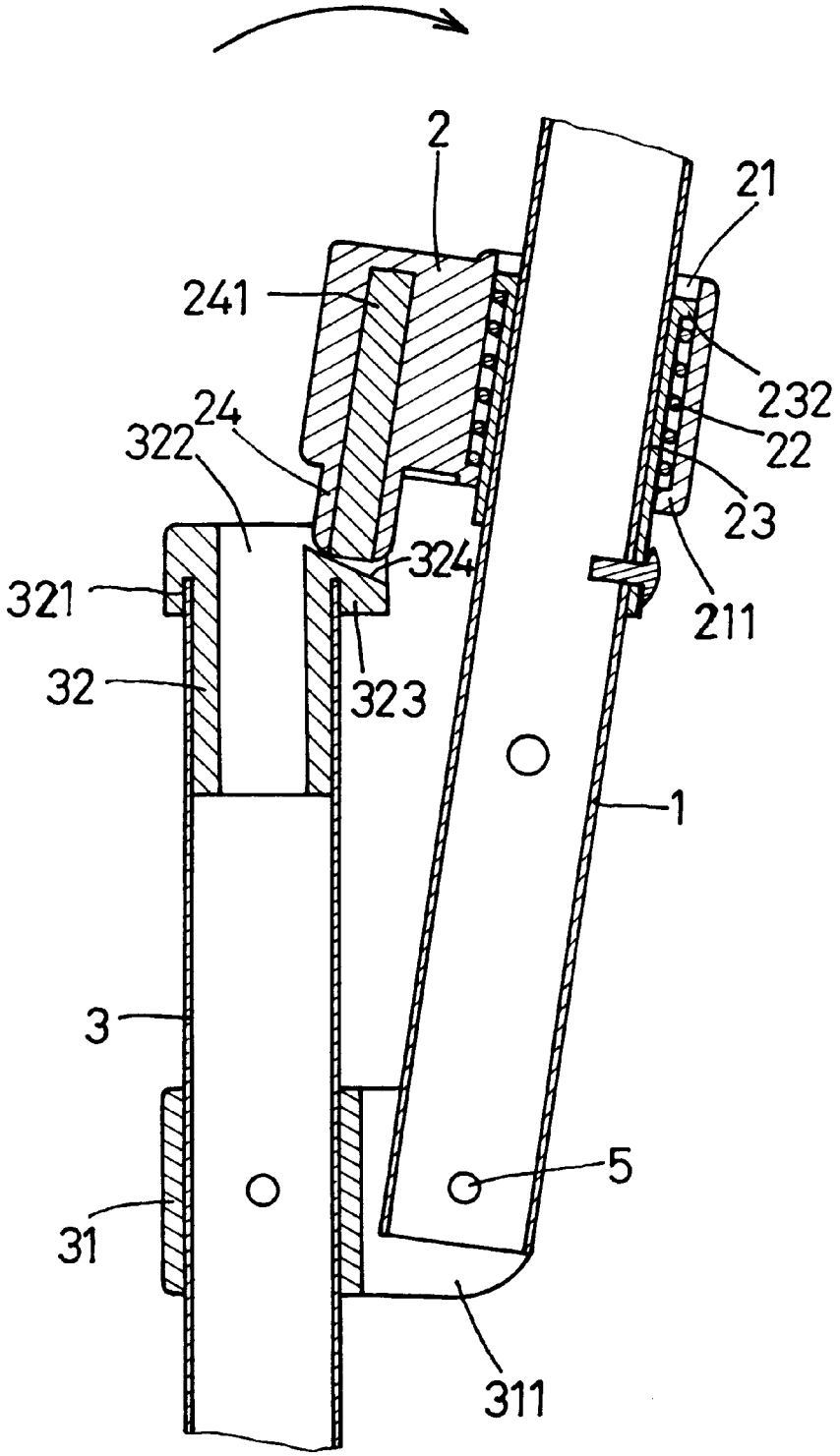
FIG. 7 is a cross-sectional view of a second stage of collapsing device of the golf cart collapsible device in the present invention.
Figure 8:
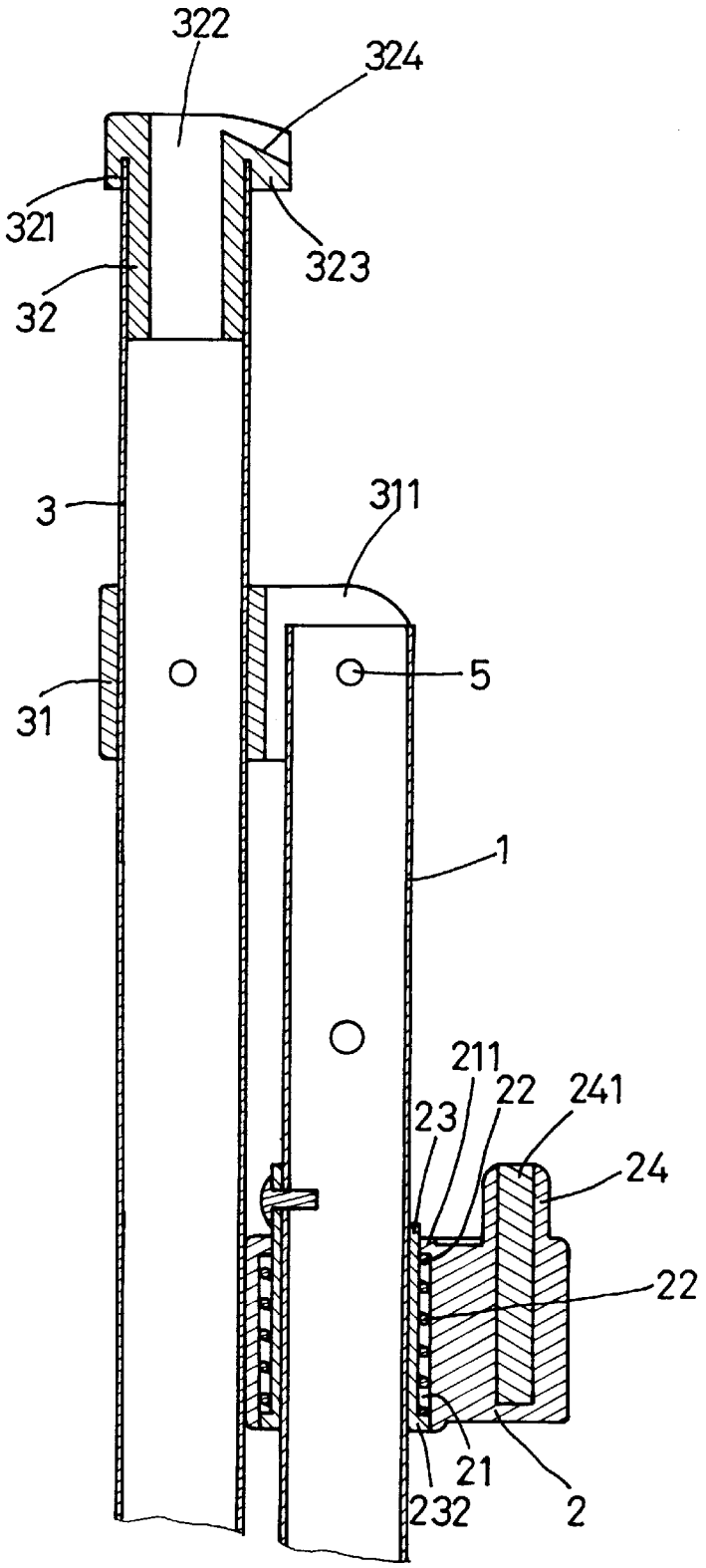
FIG. 8 is a cross-sectional view of the golf cart collapsible device in the collapsed position in the present invention.
Figure 9:
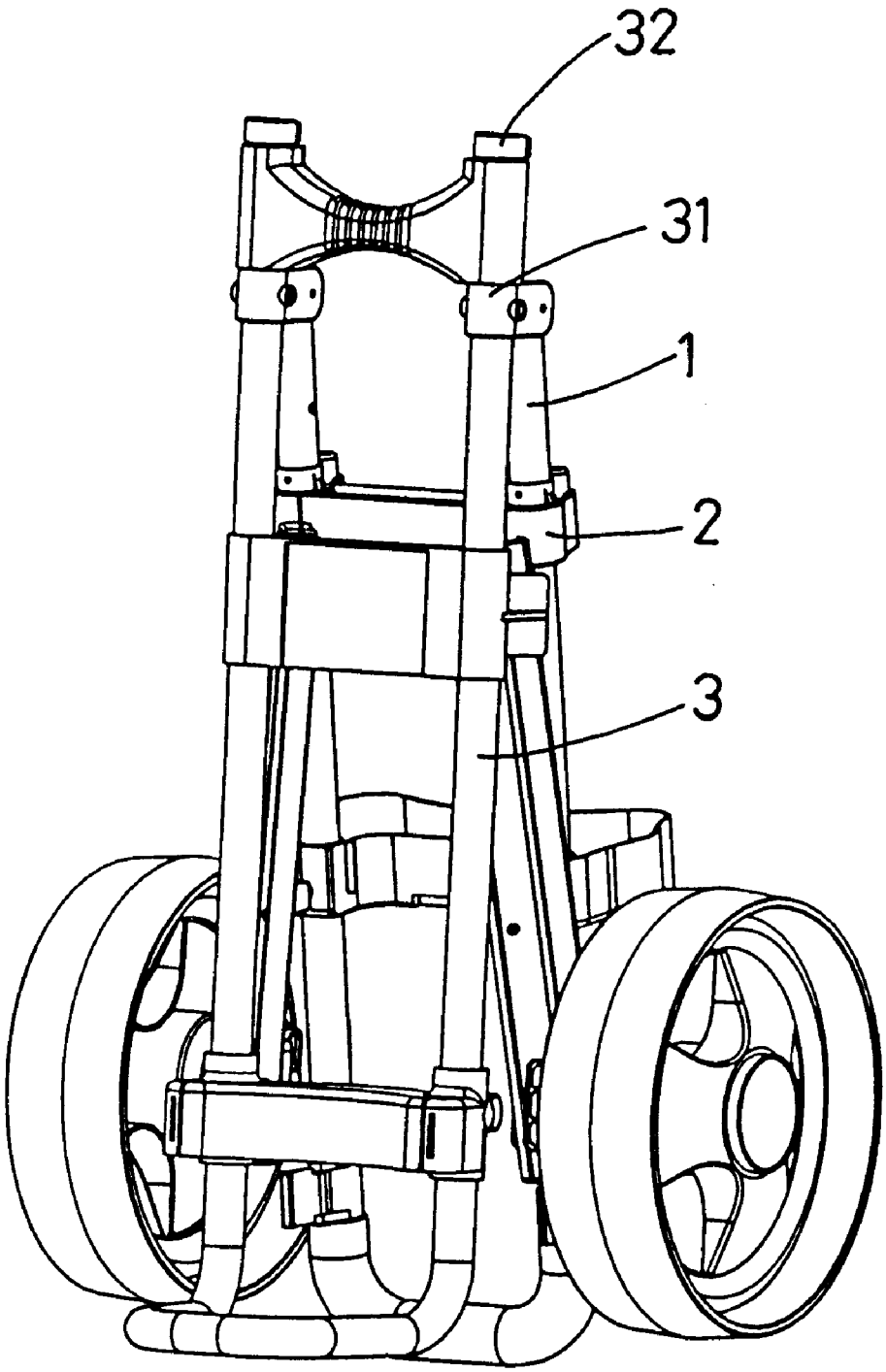
FIG. 9 is a perspective view of the golf cart provided with the collapsible device in the collapsed position in the present invention; and, FIG. 10 is a perspective view of the golf cart provided with the collapsible device in the shrunk position in the present invention.

FIGS. 3 and 5 show the golf cart collapsible device expanded fully, with the engage members 24 engaging the center holes 322 of the two second sleeves 32, letting the two handle bars 1 aligned to the two frame bars 3 and connected to each other in a stabilized condition. At this time the coil springs 22 are in a lengthened condition. If it is to be collapsed, the lock base 2 is pulled up forcefully, carrying the two engage members 24 disengaging from the center holes 322 of the two second sleeves 32, with the coil springs 22 being in a compressed condition, as shown in FIG. 6. Then the handle bars 1 are swung down for 180 to lie side by side behind the frame tubes 3, as shown in FIGS. 7, 8 and 9. Thus the collapsing of the device is finished. On the contrary, if it is to be expanded from the collapsed position, the process of just described above is done reversely to attain the object, by swinging the handle bars 1 up for 180, and then the engage members 24 are pushed automatically to slide in the center holes 322 of the second sleeves 32, as shown in FIG. 5, and then the handle bars 1 become locked in the aligned condition to the frame tubes 3, as shown in FIG. 3.

In general, as described above, in collapsing this device, only pulling up the lock base 2 enables the handle bars 1 to be swung up for 180 degrees to the rear side of the frame tubes 3. In expanding this device, only swinging up for 180 the handle bars 1 can permit them to automatically locked in the expanded condition, very easy to handle, and far superior to the conventional ones.

Figure 10:
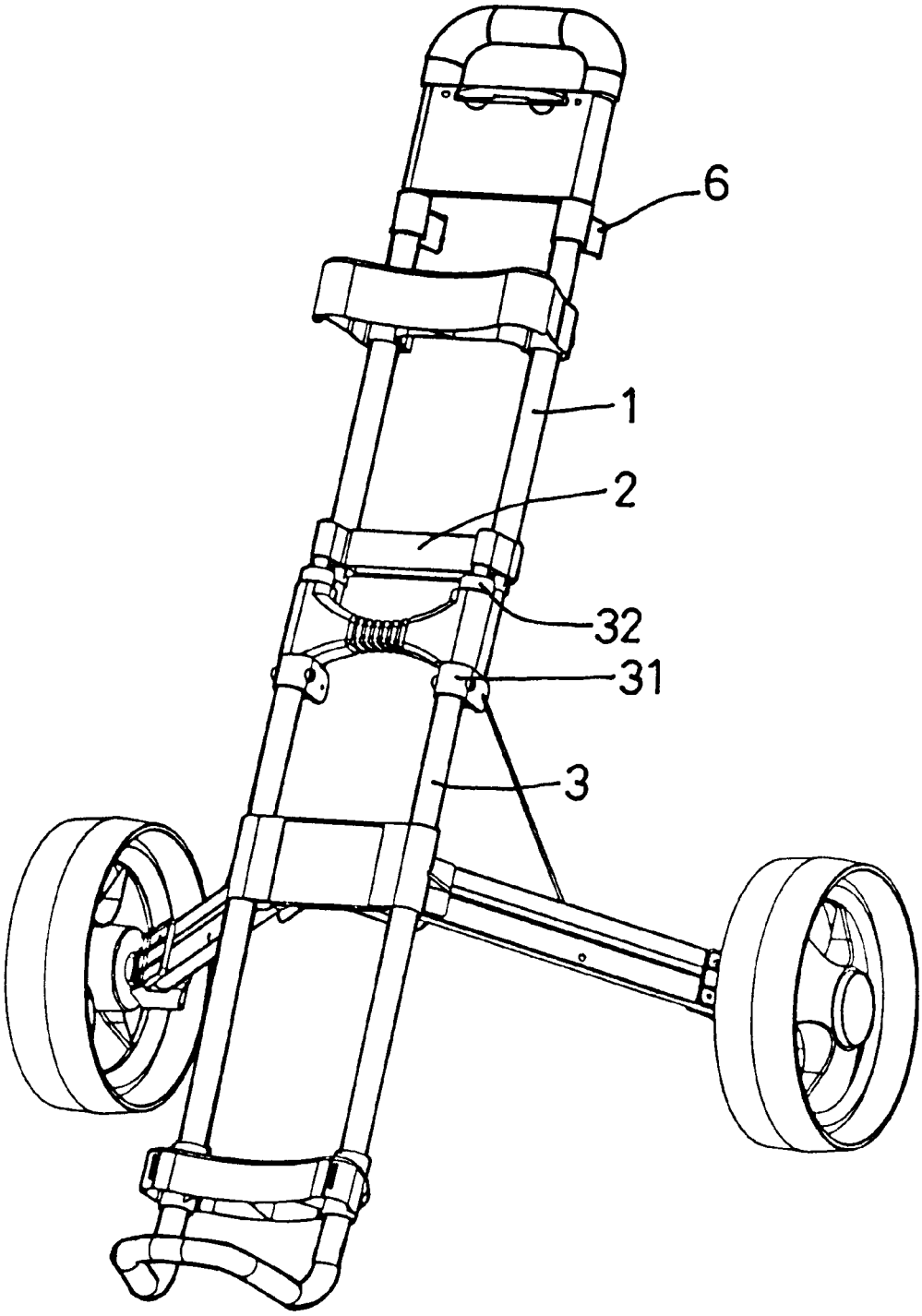

In addition, a shrinking device 6 shown in FIG. 10 may be provided on the two handle bars 1 so that the handle bars 1 may be shrunk for a certain distance before they are collapsed. Then the handle bars 1 may be shorter in the collapsed condition. But it is a well-known art, not described here.

While the preferred embodiment of the invention has been described above, it will be recognized and understood that various modifications may be made therein and the appended claims are intended to cover all such modifications which may fall within the spirit and scope of the invention.

I claim:

1. A golf cart collapsible device comprising:

two parallel handle bars:

two parallel frame tubes to which lower ends of said two parallel handle bars are pivotally connected, having a second sleeve fitted in an upper end, said second sleeves having a center hole and a guide projection extending out from an upper end and having a tapered surface communicating with said center hole;

a lock base provided on said two handle bars and located on top of said two frame tubes, having a bar hole respectively formed in two ends, a coil spring fitted in each said bar hole and a first sleeve fitted in said coil spring, each said handle bar fitting in (a respective said first sleeve) and fixed together, said lock base further having an elasticity by means of said coil springs to move up and down in a limited distance along said handle bars, and an engage member extending down from a side of each said bar hole; and, said handle bars swung up for 180 degrees from a collapsed position and said lock base automatically pushed down by said coil spring to let said engage members fit in said center holes of said second sleeves of said frame tubes in an expanded position; said lock base pulled up to let said engage members disengage from said center holes of said second sleeves in the expanded position and then said two handle bars swung down for 180 degrees to lie side by side behind said two frame tubes in the collapsed position.

2. The golf cart collapsible device as claimed in claim 1, wherein said second sleeves respectively have a guide block extending out from an upper end, and said tapered surface is provided on its upper surface.

3. The golf cart collapsible device as claimed in claim 1, wherein said tapered surfaces of said second sleeves slope up to said center holes of said second sleeves.

4. The golf cart collapsing device as claimed in claim 1, wherein said lock base has a bar hole respectively in two ends for containing said coil spring, said first sleeves respectively fitting in said coil springs, said bar hole having a lower inner annular projection, said first sleeves respectively having an upper flange, said coil springs respectively limited between said lower inner annular projections of said bar holes and said upper flanges of said first sleeves.

5. The golf cart collapsible device as claimed in claim 1, wherein said first sleeves respectively have a projecting-out tenon formed on an outer surface, stopped by a lower end of said lock base.

6. The golf cart collapsible device as claimed in claim 1, wherein said two engage members of said lock base respectively have a center hole for a pin to fit therein to reinforce the strength of said engage members.

* * * * *